US011022397B2

(12) United States Patent
Williams et al.

(10) Patent No.: US 11,022,397 B2
(45) Date of Patent: Jun. 1, 2021

(54) FIREARM CLEANING PATCH

(71) Applicant: Otis Products, Inc., Lyons Falls, NY (US)

(72) Inventors: Nicholas Williams, Naples, FL (US); Nathan Williams, Naples, FL (US)

( * ) Notice: Subject to any disclaimer, the term of this patent is extended or adjusted under 35 U.S.C. 154(b) by 0 days.

(21) Appl. No.: 16/526,202

(22) Filed: Jul. 30, 2019

(65) Prior Publication Data

US 2020/0103198 A1 Apr. 2, 2020

Related U.S. Application Data

(60) Provisional application No. 62/712,536, filed on Jul. 31, 2018.

(51) Int. Cl.

| | |
|---|---|
| ***F41A 29/02*** | (2006.01) |
| ***B08B 9/04*** | (2006.01) |
| ***D06H 7/00*** | (2006.01) |
| ***D06H 1/02*** | (2006.01) |

(52) U.S. Cl.

CPC ..... *F41A 29/02* (2013.01); *B08B 9/04* (2013.01); *D06H 1/02* (2013.01); *D06H 7/00* (2013.01); *D10B 2201/02* (2013.01)

(58) Field of Classification Search

CPC .. F41A 29/02; B08B 9/04; D06H 1/02; D06H 7/00; D10B 2201/02

USPC ..... 42/95

See application file for complete search history.

(56) References Cited

U.S. PATENT DOCUMENTS

| | | | | |
|---|---|---|---|---|
| 1,849,779 | A * | 3/1932 | Zimmerman | D06H 7/02 83/46 |
| 4,499,625 | A * | 2/1985 | Bottomley | F41A 29/02 15/104.165 |
| 4,778,638 | A * | 10/1988 | White | F41H 1/08 264/152 |
| 4,908,877 | A * | 3/1990 | White | A42B 3/063 2/412 |
| 6,321,457 | B1 * | 11/2001 | Lariviere, Jr. | B26B 29/06 33/562 |
| 2007/0294931 | A1 * | 12/2007 | Kettles | B65D 81/3261 42/95 |
| 2010/0229773 | A1 * | 9/2010 | Droese | D05B 97/12 112/475.08 |

* cited by examiner

*Primary Examiner* — John Cooper

(57) ABSTRACT

A method for manufacturing a firearm cleaning patch includes: providing a sheet of a material; cutting a plurality of hex shaped patches from the sheet of a material; and perforating or marking at least one slit on at least one hex shaped patch. A firearm cleaning patch and a method for cleaning the barrel of a firearm are also described.

9 Claims, 6 Drawing Sheets

FIREARM CLEANING PATCH

CROSS-REFERENCE TO RELATED APPLICATIONS

This application claims priority to and the benefit of co-pending U.S. provisional patent application Ser. No. 62/712,536, FIREARM CLEANING PATCH, filed Jul. 31, 2018, which application is incorporated herein by reference in its entirety.

FIELD OF THE APPLICATION

The application relates to a firearm cleaning patch and particularly to an efficient method of manufacture of firearm cleaning patches.

BACKGROUND

The bore of a barrel of a firearm should be cleaned periodically to remove undesirable residues of gunpowder, copper, and lead that can corrode the bore or otherwise impede operation of the firearm. Common firearms used in the military, law enforcement, hunting and sport shooting include various types of pistols, handguns, shotguns, bolt action and semi-automatic rifles, assault rifles, machine guns, and grenade launchers, referred to herein collectively as "firearms."

A swab formed from a flexible material such as cloth can be inserted into a slotted tip or folded over a tip of a plug and pulled or pushed through the barrel of a firearm to clean the barrel.

SUMMARY

According to one aspect, a method for manufacturing a firearm cleaning patch includes: providing a sheet of material; cutting a plurality of hex shaped patches from the sheet of material; and perforating or marking at least one slit on at least one hex shaped patch.

In one embodiment, the step of providing includes, providing a sheet of a fabric.

In another embodiment, the step of cutting includes, cutting the sheet of a fabric into a plurality of hex shaped patches having a diameter in a range of about 1" to 2".

In yet another embodiment, the step of cutting includes, cutting the sheet of a fabric into a plurality of hex shaped patches having a diameter in a range of about 2" to 4".

In yet another embodiment, the step of cutting includes, cutting the sheet of a fabric into a plurality of hex shaped patches having a diameter in a range of about 4" to 6".

In yet another embodiment, the method further includes a step of, marking or scoring the at least one hex shaped patch to facilitate pinching or folding of the at least one hex shaped patch.

In yet another embodiment, the step of marking includes, marking by colored lines.

In yet another embodiment, the step of providing includes, providing a sheet of a cotton fabric.

According to another aspect, a firearm cleaning patch includes a piece of material which is hex shaped when flat. At least one slit marking or slit is disposed on or in the hex shaped piece of material. At least one mark or score is disposed on or in the hex shaped piece of material as denoting a fold or pinch point. The hex shaped piece of material is adapted to have a wadded swab shape when folded and installed on a tool bit to pull through a barrel of a firearm.

In one embodiment, the hex shaped piece of material includes a hex shaped piece of fabric.

According to another aspect, a method for cleaning the barrel of a firearm, includes providing a hex shaped cleaning patch; attaching the cleaning patch to a first end of an elongated member by passing a portion of the elongated member through a slit in the hex shaped cleaning patch, pinching the cleaning patch at a marked location on the cleaning patch, and pulling a portion of the hex shaped cleaning patch through a slot in the elongated member; passing a second end of the elongated member through a barrel of a firearm; drawing the hex shaped cleaning patch into the barrel; and drawing the first end and the hex shaped cleaning patch through the barrel.

The foregoing and other aspects, features, and advantages of the application will become more apparent from the following description and from the claims.

BRIEF DESCRIPTION OF THE DRAWINGS

The features of the application can be better understood with reference to the drawings described below, and the claims. The drawings are not necessarily to scale, emphasis instead generally being placed upon illustrating the principles described herein. In the drawings, like numerals are used to indicate like parts throughout the various views.

Rough drawings of hex patches were made from original pictures of round patches, any round patch shapes in the rough drawings should be ignored with respect to the solid lines showing the new hex shaped patches.

DETAILED DESCRIPTION

As described hereinabove, the bore of a barrel of a firearm should be cleaned periodically to remove undesirable residues of gunpowder, copper, and lead that can corrode the bore or otherwise impede operation of the firearm. Common firearms used in the military, law enforcement, hunting and sport shooting include various types of pistols, handguns, shotguns, bolt action and semi-automatic rifles, assault rifles, machine guns, and grenade launchers, referred to herein collectively as "firearms."

Figure 1:
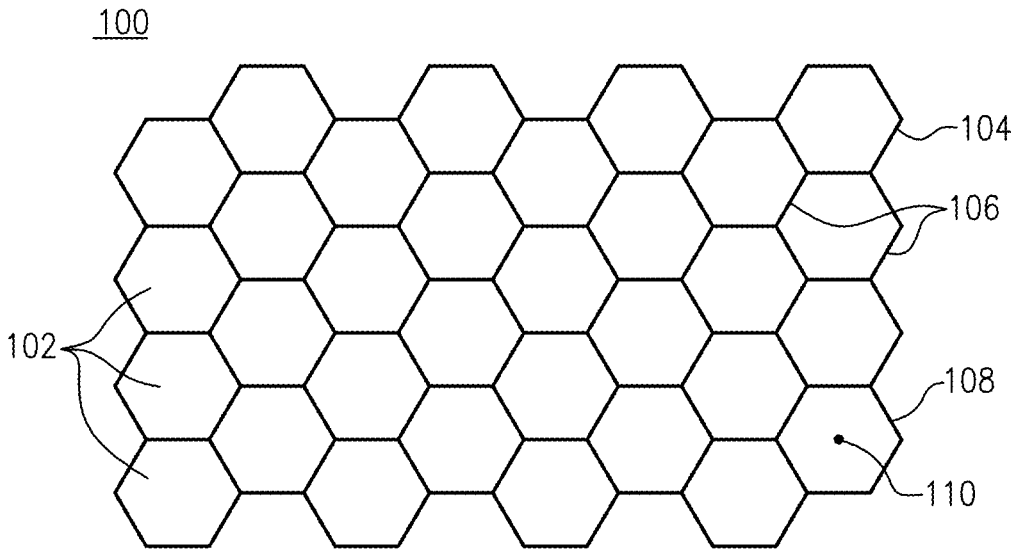
FIG. 1 shows a hexagonal fabric cutting pattern according to the Application.

A swab formed from a flexible material such as cloth can be inserted into a slotted tip or folded over a tip of a plug and pulled or pushed through the barrel of a firearm to clean the barrel. Typically, the patch of flexible material such as a cloth is inserted into a slotted tip or folded over a tip of a plug having a fixed diameter designed to form a wadded swab to apply to a relatively narrow range of weapon calibers. For example, U.S. Pat. No. 4,716,673, FIGS. 8*a-e* show perspective views of a cleaning patch and a gun barrel cleaning tip having a patch receiving slot. Also, U.S. Pat. No. 7,356,961, FIG. 1 shows an exploded view of components that form a patch related firearm cleaning device, and '961, FIG. 1A a perspective view of the device. Because of the varying diameters of the bores of barrels on different types of weapons, the patches are manufactured in different sizes, and used folded in different ways to form a wadded swab. The '673 and '961 patents are incorporated herein by reference in their entirety for all purposes.

The '673 patent described use of a circular patch where for large diameter gun barrels, the end of a cleaning tip was placed through a first hole, and for small diameter gun barrels, it was placed through a second hole close the edge of the circular patch. By attaching the patch cleaning tip through the hole near the edge, a greater portion of the patch could trail the cleaning tip when in a gun barrel, thereby reducing the effective diameter of the cleaning tip and patch combination.

Patches are typically made and sold in circular shapes. Unfortunately, punching or cutting circles from a sheet of material, typically a sheet of fabric, leaves a significant amount of wasted material.

An efficient method of manufacturing a gun cleaning patch is needed to reduce the amount of patch material waste created in manufacturing. The new patches, while making more efficient use of the raw sheets of material from which they are cut, typically from sheets of fabric, should be useable in place of and as easily as the round patches of the prior art.

It was realized that patches can be more efficiently produced with far less wasted material as hex shaped patches. FIG. 1 shows an exemplary hexagonal pattern outlining the sides of hexagonal patches to be cut from a section of fabric during the manufacture of cleaning patches according to the Application.

It was also realized that by locating the slit for a pulling tool away from the center of the patch, a hex patch can be used to clean a range of bore diameters (e.g. a range of caliber firearms) by pinching the patch at one of a plurality of marks, such as printed marks, or scored marks (e.g. visible marks made by any suitable scoring technique) around the perimeter of a hex patch at varying distances from the slit through which the tip of the cleaning tool passes at least part way through. After pinching the hex patch at the desired pinch mark, as described hereinbelow in more detail, a portion of the hex patch is pulled through a patch receiving slot in a tip of the pulling tool.

Definitions

Diameter of a hex shaped patch—The diameter of a hex shaped patch is defined in the traditional manner as the diameter of a circle that bisects each vertex of the hex shape. The exemplary diameter dimensions of the hex shaped patched described hereinbelow refer to the dimensions of a flat hex patch, before threading, pinching, and/or folding (e.g. when flat on a table top).

Swab—A hex shaped patch once pinched or folded and installed on a tool bit, such as, for example, a slotted tool bit, is referred to hereinbelow as a swab. The dimensions of a wadded swab hex patch are made suitable for a particular sized bore of a firearm to be cleaned. The fold or pinch points can be marked or scored onto the surface of the hex patch. As known to those skilled in the art, the wadded swab shape can be further modified by addition of a plug on the tool bit in addition to the folded hex patch, typically threaded through a slot thereof.

Method of manufacture—As shown, for example, in FIG. 1 a section of any suitable material, typically a fabric 100 is cut into hexagonal patches 102. The new method can be used to manufacture the exemplary hex patches shown in FIG. 2, FIG. 3, and FIG. 4 (i.e. small caliber cleaning patches 202, medium caliber cleaning patches 302, and large caliber cleaning patches 402). The cuts are made following a hexagonal pattern 104 so that the cuts result in the formation of the sides 106 of the hexagonal patches 102 cut from the fabric 100.

The fabric 100 can include natural materials, such as cotton or wool, artificial materials, such as polyester, or any combination thereof.

Hexagonal patches 102 (substantially regular hexagons) are positioned so that each side 106 of one of the hexagonal patches 102 in the form of approximately regular hexagons cut according to the pattern 104 is shared with a side 106 of another hexagonal patch 102 in the form of an approximately regular hexagon in the pattern 104, except where the side 106 of a hexagonal patch 102 is on the outer perimeter 108 of the overall pattern 100.

Hexagonal patches 102 can be cut from the fabric 100 manually by fabric shears or any suitable manual fabric cutting tool. Alternatively, the hexagonal patches 102 can be cut from the fabric by use of any suitable fabric cutting machine including, for example, water jet cutting, laser cutting, punching, etc., including any suitable automated cutting machine. Hexagonal patches 102 can be produced in a variety of sizes.

As shown in FIGS. 1-4, small caliber cleaning patches 202 can be produced from hexagonal patches 102 with a diameter in the range of about 1" to about 2" for example, for cleaning .177-.27 firearms. Medium caliber cleaning patches 302 can be produced from hexagonal patches 102 with a diameter in the range of about 2" to about 4" for example, for cleaning .22-.45 firearms. Large caliber cleaning patches 402 can be produced from hexagonal patches 102 with a diameter in the range of about 4" to about 6", for example, for cleaning 0.45"-60 mm firearms.

Patch slits—At least one slit 204 or similarly restrictive hole is formed in a hexagonal patch 102 to produce a small caliber cleaning patch 202, medium caliber cleaning patch 302, or large caliber cleaning patch 402. The slit 204 accommodates a pulling tool 206. Any suitable pulling (or pushing) tool can be used, including, for example, a cable, rod, jag, brush, etc. and any combination thereof. The cleaning patch 202, 302 or 402 is affixed to the tool by any suitable tool bit (e.g. a slotted tool bit). By positioning the slits 204 in different positions, different parts of a cleaning patch 202, 302 or 402 can be exposed to the wall of the bore of a firearm. Typical means for attaching a cleaning patch 202, 302, or 402 to the pulling tool 206 include slotted (e.g. the exemplary slotted tip of FIG. 2, FIG. 3, and FIG. 4), pinching, and/or clamping devices. Exemplary pulling tool 206 includes a cleaning tip having a patch receiving slot.

Figure 2:
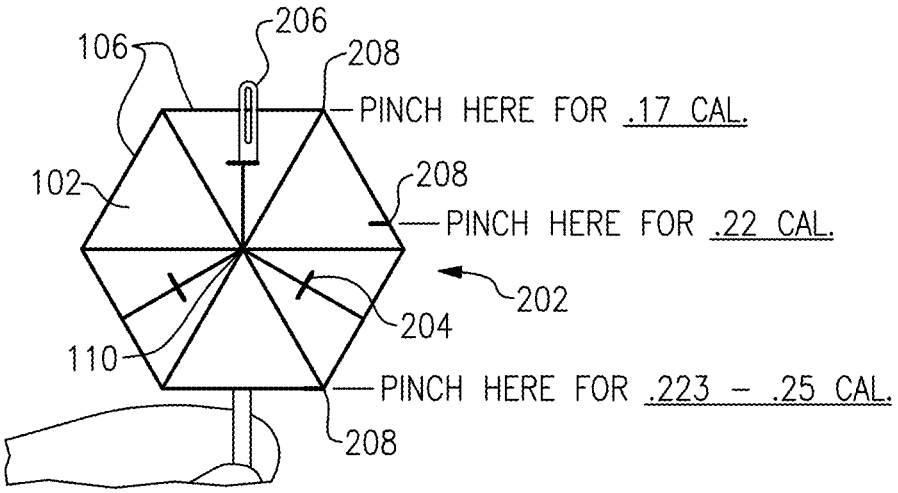
FIG. 2 shows a diagram of a small caliber cleaning patch.

FIG. 2 shows a diagram of a small caliber cleaning patch with a pulling tool and a slotted tool bit. Markings on the diagram of the small caliber cleaning patch show where perforations and/or scoring marks can be formed in the manufacture of a small caliber cleaning patch, and where a small caliber cleaning patch should be pinched for folding during use in cleaning. A small caliber cleaning patch is typically used to clean the barrels of .17, .22, or .223-.25 caliber firearms.

In the exemplary embodiment of FIG. 2, a small caliber cleaning patch 202, three slits 204 are disposed in the small caliber cleaning patch 204. The first of the three slits 204 is formed between the center 110 of a hexagonal patch 102 used to make the small caliber cleaning patch 202 and nearest point on a side 106 of the hexagonal patch 102. The other two of the three slits 204 are formed on the hexagonal patch 102 so that they, together with the first of the three slits 204 are about symmetrically disposed about the center 110 of the hexagonal patch 102 to form a small caliber cleaning patch 202 with three about symmetrically disposed slits 204, as shown in FIG. 2.

Figure 3:
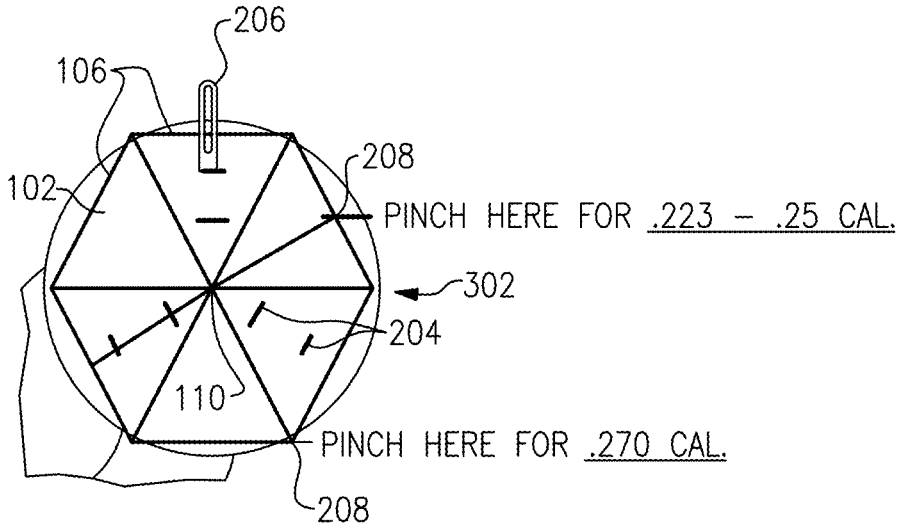
FIG. 3 shows a diagram of a medium caliber cleaning patch.

FIG. 3 shows a diagram of a medium caliber cleaning patch with a pulling tool, with markings on the diagram of the medium caliber cleaning patch showing where perforations and/or scoring marks are to be formed in the manufacture of a medium caliber cleaning patch, and where a medium caliber cleaning patch should be pinched for folding for particular sized barrel bores. A medium caliber cleaning patch is typically used to clean the barrels of 223-.25, or .27 caliber firearms.

In the embodiment of FIG. 3, a medium caliber cleaning patch 302, six slits 204 are disposed in three pairs in the medium caliber cleaning patch 302. The first of the three pairs of slits 204 is formed between the center 110 of a hexagonal patch 102 used to make the medium caliber cleaning patch 302 and nearest point on a side 106 of the hexagonal patch 102. For each pair of slits 204 of the exemplary embodiment of FIG. 3, one slit 204 is formed approximately one-third of the distance from the center of the hexagonal patch 102 to a side 106, and a second slit 204 is formed approximately two-thirds of the distance from the center of the hexagonal patch 102 to that same side 106. The other two pairs of slits 204 are formed on the hexagonal patch 102 so that they, together with the first of the three slits 204 are symmetrically disposed about the center 110 of the hexagonal patch 102 to form a medium caliber cleaning patch 302 with three symmetrically disposed pairs of slits 204, as shown in FIG. 3.

Figure 5:
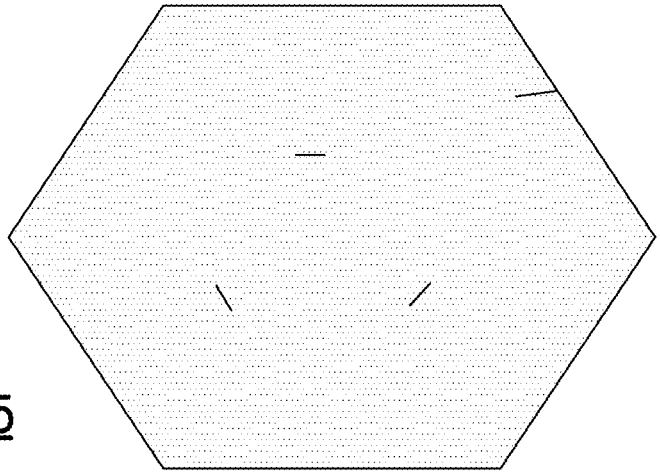
FIG. 5 shows a drawing of another exemplary hex patch cut from a sheet of fabric, where the slits and marks are indicated by scoring.
Figure 6:
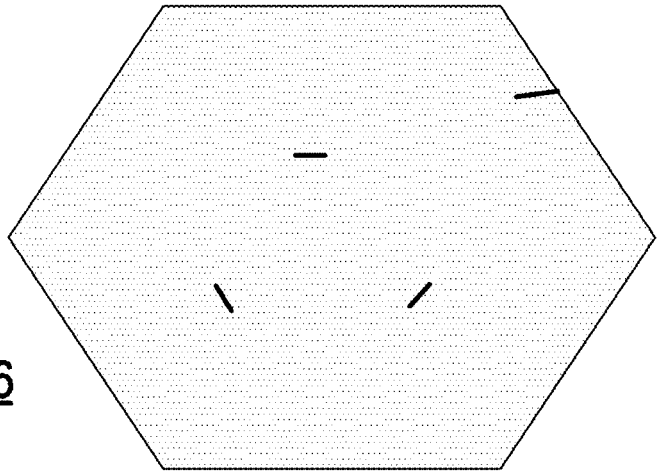
FIG. 6 shows a drawing of the exemplary hex patch of FIG. 5, where the slits and marks are indicated by black lines.

FIG. 5 shows a drawing of another exemplary medium caliber cleaning hex patch cut from a sheet of fabric, where the slits and marks are indicated by scoring. FIG. 6 shows a drawing of the exemplary medium caliber cleaning hex patch of FIG. 5, where the slits and marks are indicated by black lines. There can also be three additional marks of slits as shown in FIG. 3.

Figure 4:
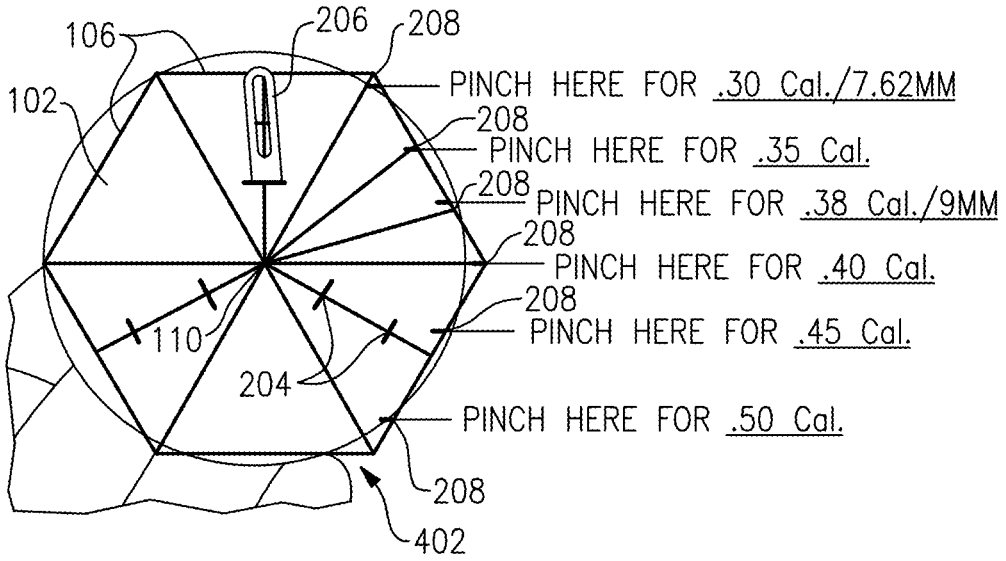
FIG. 4 shows a diagram of a large caliber cleaning patch.

FIG. 4 shows a diagram of a large caliber cleaning patch with a pulling tool, with markings on the diagram of the large caliber cleaning patch showing where perforations and/or scoring marks are to be formed in the manufacture of a large caliber cleaning patch, and where a large caliber cleaning patch should be pinched for folding during use in cleaning. A large caliber cleaning patch is typically used to clean the barrels of .30, .35, .38, .40, .45, .50, 7.6 mm, and 9 mm) caliber firearms.

In the embodiment of FIG. 4, a large caliber cleaning patch 402, six slits 204 are disposed in three pairs in the large caliber cleaning patch 402. In the exemplary embodiment of FIG. 4, the first of the three pairs of slits 204 is formed between about the center 110 of a hexagonal patch 102 used to make the medium caliber cleaning patch 402 and a nearest point on a side 106 of the hexagonal patch 102. For each pair of slits 204, one slit 204 is formed approximately one-third of the distance from the center of the hexagonal patch 102 to a side 106, and a second slit 204 is formed approximately two-thirds of the distance from the center of the hexagonal patch 102 to that same side 106. The other two pairs of slits 204 are formed on the hexagonal patch 102 so that they, together with the first of the three slits 204 are symmetrically disposed about the center 110 of the hexagonal patch 102 to form a large caliber cleaning patch 402 with three symmetrically disposed pairs of slits 204, as shown in FIG. 4.

As shown in FIG. 2, FIG. 3, and FIG. 4, in manufacturing the small caliber cleaning patches 202, medium caliber cleaning patches 302, and large caliber cleaning patches 402, the hexagonal patches 102 are typically marked (or scored) with marks 208 to instruct a user and facilitate the pinching and folding of the small caliber cleaning patches 202, medium caliber cleaning patches 302, and large caliber cleaning patches 402, during use. The marks 208 can be printed on the hexagonal patches 102 prior to cutting the hexagonal patches 102 from the fabric 100 shown in FIG. 1, during cutting, or after cutting, and can be printed or marked by any suitable manual or machine means.

As shown in FIG. 2, one embodiment of a small caliber cleaning patch 202 is manufactured with at least three marks 208, disposed so as to indicate to a user the location for pinching and folding the small caliber cleaning patch 202 for cleaning firearms of .17 caliber, .22 caliber, or .223-.25 caliber. As shown in FIG. 3, one embodiment of a medium caliber cleaning patch 302 is manufactured with at least two marks 208, disposed so as to indicate to a user the location for pinching and folding the medium caliber cleaning patch 302 for cleaning firearms of .223-.225 caliber or .27 caliber. As shown in FIG. 4, one embodiment of a large caliber cleaning patch 402 is manufactured with at least six marks 208, disposed so as to indicate to a user the location for pinching and folding the large caliber cleaning patch 402 for cleaning firearms of .30 caliber/7.62 MM, .35 caliber, .38 caliber/9 MM, .40 caliber, .45 caliber, or .50 caliber.

In summary and with reference to the hex patch of exemplary FIG. 1 and FIG. 2, a method for manufacturing a firearm cleaning patch 102 includes: providing a sheet of a material 100; cutting the sheet of a fabric into a plurality of hex shaped patches 102; and perforating or marking at least one slit 204 on at least one hex shaped patch 102.

In some embodiments, and with reference to the hex patch of exemplary FIG. 2, a firearm cleaning patch 102 includes a hex shaped piece of material when flat. At least one slit marking or slit 204 is disposed on or in the hex shaped piece of material. At least one mark or score 208 is disposed on or in the hex shaped piece of material as denoting a fold or pinch point. The hex shaped piece of material 102 is adapted to have a wadded shape when folded and installed on a tool bit to pull through a barrel of a firearm.

Cleaning methods

Referring to FIG. 2, a small caliber cleaning patch 202 can be used in the cleaning of a .17 caliber, .22 caliber, or .223-.25 caliber firearm. A pulling tool 206 is passed through a slit in the small caliber cleaning patch 202, as shown in FIG. 2. Depending on the caliber of the firearm to be cleaned, the small caliber cleaning patch 202 is pinched at a mark 208 corresponding to the appropriate pinching location for cleaning a .17, .22, or .223-.25 caliber firearm. The pinched portion of the small caliber cleaning patch 202 is then pulled through a slot 210 in the pulling tool 206 in order to secure the small caliber cleaning patch 202 to the pulling tool 206. Then, the portion of the small caliber cleaning patch 202 that was not passed through the slot 210 is pulled and folded over the portion of the small caliber cleaning patch 202 that was passed through the slot 210. The folded small caliber cleaning patch 202 is then pulled through the barrel bore of a firearm as a waded swab, to clean the firearm.

Re-use, multiple use—Where a small caliber cleaning patch 202 with more than one slit 204 is used, the small caliber cleaning patch 202 can then be unfolded and detached from the pulling tool 206 and later re-used utilizing a different slit 204 in the process than a previously-used slit 204. Alternatively, the small caliber cleaning patch 202 can then be unfolded and detached from the pulling tool 206, flipped over, and later re-used by inserting the pulling tool 206 through a previously utilized slit 204 so that the pulling tool 206 passes through the slit 204 from a different direction relative to the direction in which it passed through the slit 204 during a prior use. This allows for a small caliber cleaning patch 202 with three slits 204 to be used at least about six times, where each time accounts for the combination of a particular slit 204 being used with the pulling tool 206 passing through the slit 204 for one of two uses, each use from a different direction.

Referring to FIG. 3, a medium caliber cleaning patch 302 can be used in the cleaning of a .223-.25, or .70 caliber firearm. A pulling tool 206 is passed through a slit in the medium caliber cleaning patch 302, as shown in FIG. 3. Depending on the caliber of the firearm to be cleaned, the medium caliber cleaning patch 302 is pinched at a mark 208 corresponding to the appropriate pinching location for cleaning a .223-.25, or .70 caliber firearm. The pinched portion of the medium caliber cleaning patch 302 is then pulled through a slot 210 in the pulling tool 206 in order to secure the medium caliber cleaning patch 302 to the pulling tool 206. Then, the portion of the medium caliber cleaning patch 302 that was not passed through the slot 210 is pulled over the portion of the medium caliber cleaning patch 302 that was passed through the slot 210. The folded medium caliber cleaning patch 302 is then pulled through the barrel bore of a firearm as a wadded swab, to clean the firearm.

Where a medium caliber cleaning patch 302 or large caliber cleaning patch 402 with more than one slit 204 is used, the medium caliber cleaning patch 302 can also be unfolded and detached from the pulling tool 206 and later re-used utilizing a different slit 204 in the process than a previously used slit 204. Alternatively, the medium caliber cleaning patch 302 can be unfolded and detached from the pulling tool 206, flipped over, and later re-used by inserting the pulling tool 206 through a previously utilized slit 204 so that the pulling tool 206 passes through the slit 204 from a different direction relative to the direction in which it passed through the slit 204 during a prior use. This allows for a medium caliber cleaning patch 302 with three slits 204 corresponding to measurements for a particular caliber of firearm to be used at least about six times, where each time accounts for the combination of a particular slit 204 being used with the pulling tool 206 passing through the slit 204 twice, each time from a different direction.

Similar methods can be used with the large caliber cleaning patches of FIG. 4.

Multiple use—A small caliber cleaning patch 202, medium caliber cleaning patch 302, or large-caliber cleaning patch 402 can be used more than once, utilizing a different slit 204 in a subsequent use than a slit utilized during a previous use., or by using a previously used slit by passing the pulling tool 206 through the a slit 204 from a different direction than the as previously used. During such use, the pinching and folding of the small caliber cleaning patch 202, medium caliber cleaning patch 302, or large-caliber cleaning patch 402 is done in the same way as was done during the prior use, except that the portions of the cleaning patch 202, 302, 402 that are pinched and folded are selected so that the pinches and folds made during the subsequent use are geometrically analogous to those made during the prior use. That is, positions and locations of the pinches and folds are geometrically translated across the contours of the cleaning patch 202, 302, 402 to correspond with the change in location of the slit 204 being used (and the way in which the slit 204 is being used) on the cleaning patch 202, 302, 402.

In the examples hereinabove as shown, for example, in FIG. 2-4, the slits are generally made on a reference line from about the center of a hex patch to about a center of a side of the hex shape. The slits of the examples are about perpendicular to the reference line.

In the examples hereinabove as shown, for example, in FIG. 2-4, the pinch marks for different bore sizes can be made by marks or scoring at a location along a side of the hex shaped patch. The location of each pinch mark can be marked by any convenient measurement, such as, for example, a distance from a vertex of one of the six vertices of the hex shape, an angle from line drawn from the center of the hex shape an adjacent vertex, or a perpendicular distance from a line drawn from the center of the hex shape to an adjacent vertex to where the perpendicular line intersects a side of the hex shape.

The pinch mark location varies with respect to the slit, for different bore sizes. For example, in FIG. 2, where the slit 204 in use (as shown by pulling tool) is just past half way on a reference line drawn from about the center of the hex shaped patch to about the center of the side 106 (top side, FIG. 2), the pinch mark for a .17 Cal. bore is about at the vertex nearest the slit 204. The pinch marks move around the outside or the perimeter of the hex shape away from the slit 204 as the bore size increases. For example, by .22 Cal, the pinch mark 208 is almost the next vertex on a line about perpendicular to the reference line on which slit 204 is made. By .223 Cal, the pinch mark 208 is about at the next vertex (bottom right, FIG. 2).

Similarly, for example, in FIG. 4, the slit 204 in use (as shown by the pulling tool) is just below half way on a reference line drawn from about the center of the hex shaped patch to about the center of the side 106, the pinch mark for a .30 Cal. bore is just past about the vertex nearest the slit 204. The pinch marks move around the outside or the perimeter of the hex shape away from the slit 204 as the bore size increases. For example, by .40 Cal, the pinch mark 208 is about at the next vertex on a line about perpendicular to the reference line on which slit 204 is made (right side, FIG. 4). By .50 Cal, the pinch mark 208 is just before the next vertex (bottom right, FIG. 4).

While any suitable pinch mark can be used, in the examples, the pinch marks 208 are generally shown as short lines about parallel to a line from about the center of the hex shape to a vertex which is perpendicular to the reference line on which a slit 204 is made.

Figure 7A:
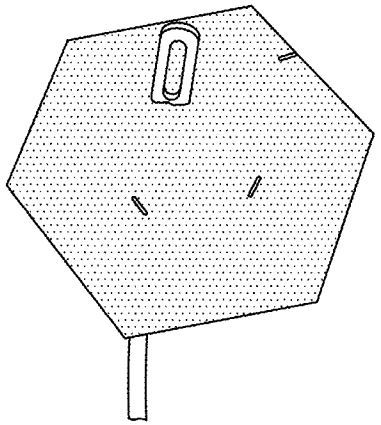
FIG. 7A shows a drawing of a slotted tool bit passed through a slit of the hex patch of FIG. 6.
Figure 7B:
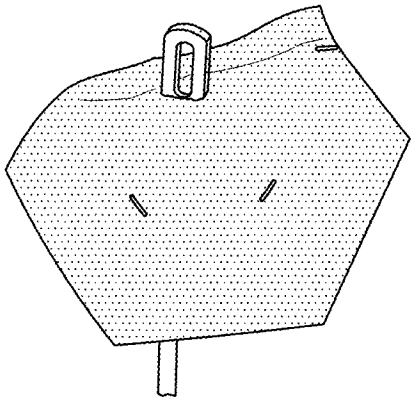
FIG. 7B shows a drawing of a pinch of an edge of the hex patch of FIG. 6.
Figure 7C:
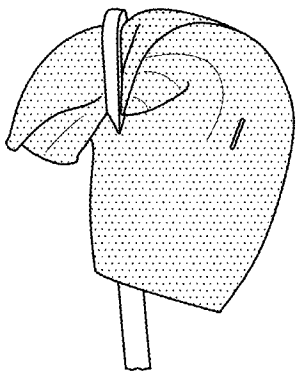
FIG. 7C shows a drawing of the pinched part threaded through the slot of FIG. 7B.
Figure 7D:
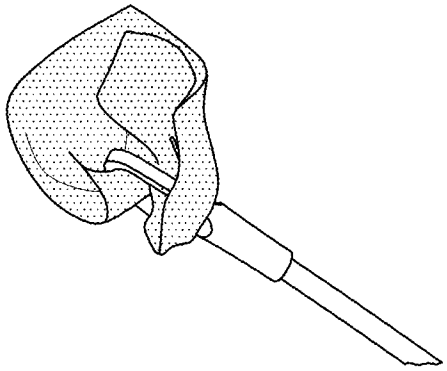
FIG. 7D shows a drawing of the wadded swab pulled tight.
Figure 7E:
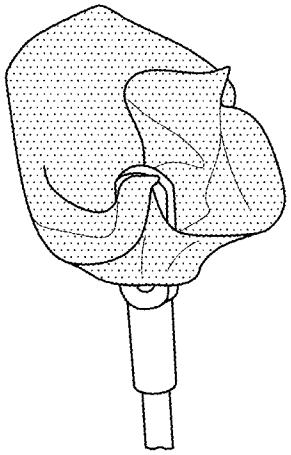
FIG. 7E shows a drawing of a re-use of the hex patch of FIG. 7A.

In summary and with respect to exemplary FIG. 2, and FIG. 7A to FIG. 7E, a method for cleaning the barrel of a firearm, includes providing a hex shaped cleaning patch 102; attaching the cleaning patch 102 to a first end of an elongated member by passing a portion of the elongated member through a slit 204 in the hex shaped cleaning patch (FIG. 7A), pinching the cleaning patch at a marked location 208 on the cleaning patch (FIG. 7B), and pulling a portion of the hex shaped cleaning patch 102 through a slot in the elongated member (FIG. 7C, and tightening the resultant swab by pulling on the tops of both parts, FIG. 7D to create a wadded swab); passing a second end of the elongated member through a barrel of a firearm; drawing the hex shaped cleaning patch 102 into the barrel; and drawing the first end and the hex shaped cleaning patch through the barrel. FIG. 7E shows a drawing of hex patch of FIG. 7A reused a second time.

It will be appreciated that variants of the above-disclosed and other features and functions, or alternatives thereof, can be combined into many other different systems or applications. Various presently unforeseen or unanticipated alternatives, modifications, variations, or improvements therein can be subsequently made by those skilled in the art which are also intended to be encompassed by the following claims.

What is claimed is:

1. A method for manufacturing a firearm cleaning patch comprising:

providing a sheet of material;

cutting a plurality of hex shaped patches from said sheet of material;

perforating or marking at least one slit on at least one hex shaped patch; and marking a pinch point at about an outer edge of said at least one hex shaped patch;

wherein said step of marking a pinch point comprises marking a pinch point about an outer edge of said at least one hex shaped patch corresponding to a firearm bore size.

2. The method of claim 1, where said step of providing comprises, providing a sheet of a fabric.

3. The method of claim 2, where said step of cutting comprises, cutting said sheet of a fabric into a plurality of hex shaped patches having a diameter in a range of about 1" to 2".

4. The method of claim 2, where said step of cutting comprises, cutting said sheet of a fabric into a plurality of hex shaped patches having a diameter in a range of about 2" to 4".

5. The method of claim 2, where said step of cutting comprises, cutting said sheet of a fabric into a plurality of hex shaped patches having a diameter in a range of about 4" to 6".

6. The method of claim 1, further comprising a step of marking or scoring said at least one hex shaped patch to facilitate pinching or folding of said at least one hex shaped patch.

7. The method of claim 6, where said step of marking comprises marking by colored lines.

8. The method of claim 1, where said step of providing comprises providing a sheet of a cotton fabric.

9. The method of claim 1, wherein said step of perforating or marking comprises perforating or marking at least one slit on at least one hex shaped patch between about ⅓ to ⅔ of a distance from a center of at least one hex patch to an outer edge of said at least one hex patch.

* * * * *